US010822852B1

(12) United States Patent
Nuss

(10) Patent No.: US 10,822,852 B1
(45) Date of Patent: Nov. 3, 2020

(54) LINEAR HINGE ASSEMBLY FOR AN APPLIANCE

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/516,308

(22) Filed: Jul. 19, 2019

(51) Int. Cl.
*E05F 1/12* (2006.01)
*E05D 3/02* (2006.01)

(52) U.S. Cl.
CPC ..... *E05F 1/1253* (2013.01); *E05D 3/022* (2013.01); *E05D 3/02* (2013.01); *E05Y 2201/224* (2013.01); *E05Y 2201/474* (2013.01); *E05Y 2900/30* (2013.01); *F25D 2323/024* (2013.01)

(58) Field of Classification Search
CPC ..... E05F 1/1246; E05F 1/1253; E05F 1/1261; E05F 5/08; E05D 3/022; E05D 7/084; E05D 11/06; E05D 2700/02; F25D 2323/024
USPC ..... 16/362, 363, 364
See application file for complete search history.

(56) References Cited

U.S. PATENT DOCUMENTS 3,588,946 A * 6/1971 MacDonald ..... E05F 1/1253 16/224
4,979,265 A * 12/1990 Grass ..... E05D 3/022 16/291
5,027,473 A * 7/1991 Hottmann ..... E05F 1/1269 16/286
5,040,857 A * 8/1991 Mandel ..... E05D 3/022 16/364
5,535,482 A * 7/1996 Grabber ..... E05D 3/022 16/286
6,205,617 B1 * 3/2001 Held ..... E05D 7/0407 16/236
6,845,545 B2 * 1/2005 Han ..... E05F 1/1269 16/277
7,234,457 B2 * 6/2007 Bartmann ..... E05B 7/00 126/192
7,240,397 B2 * 7/2007 Han ..... E05D 11/02 16/273

(Continued)

FOREIGN PATENT DOCUMENTS

CN 104949442 A 9/2015
EP 2712995 B1 8/2015

(Continued)

*Primary Examiner* — Jeffrey O'Brien
(74) *Attorney, Agent, or Firm* — Dority & Manning, P.A.

(57) ABSTRACT

An appliance includes a linear hinge assembly that couples a door to a cabinet. The linear hinge assembly includes a bearing assembly mounted to the cabinet and an elongated shaft received within the bearing assembly for sliding along a translation axis. A cam is mounted to the door and is rotatably coupled to a distal end portion of the elongated shaft such that such that the door is rotatable about a pivot axis that extends through the distal end portion of the elongated shaft. A timing cable extends from a fixed location on the cabinet to a fixed location on a cam profile such that the timing cable wraps around the cam when the door is moved toward a closed position and unwraps when the door is moved toward an open position.

20 Claims, 4 Drawing Sheets

(56) References Cited

U.S. PATENT DOCUMENTS

| | | | | |
|---|---|---|---|---|
| 7,992,951 | B2 * | 8/2011 | Kim | E05D 3/12 312/405 |
| 8,186,781 | B2 * | 5/2012 | Coleman | F25D 23/028 312/405 |
| 8,226,183 | B2 * | 7/2012 | Kang | E05D 3/18 312/405 |
| 10,138,669 | B2 * | 11/2018 | Vanini | E05F 15/627 |
| 10,400,490 | B2 * | 9/2019 | Jung | F25D 23/028 |
| 10,408,465 | B2 * | 9/2019 | Grobleben | E05F 1/1058 |
| 2004/0040118 | A1 * | 3/2004 | Han | E05F 1/14 16/277 |
| 2005/0212392 | A1 * | 9/2005 | Jung | E05D 11/1064 312/405 |
| 2010/0283367 | A1 * | 11/2010 | Coleman | E05D 3/022 312/405 |
| 2020/0217115 | A1 * | 7/2020 | Nuss | F25D 23/028 |

FOREIGN PATENT DOCUMENTS

| | | | |
|---|---|---|---|
| KR | 20040006118 | A | 1/2004 |
| KR | 20130119274 | A | 10/2013 |

* cited by examiner

LINEAR HINGE ASSEMBLY FOR AN APPLIANCE

FIELD OF THE INVENTION

The present subject matter relates generally to refrigerator appliances, and more particularly, to linear hinges for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Refrigerator appliances are commonly positioned within a recess in a row of cabinets mounted to a wall in a kitchen. In order to improve the appearance of the refrigerator appliance and minimize protrusion into kitchen walkways, certain refrigerator appliances are designed to be flush mount, where the front of the appliance door sits substantially flush with a front of the cabinets when the doors are closed. In addition, such refrigerators may be designed for receiving a cabinet panel, such that the front appearance of the refrigerator appliance matches the appearance of the cabinetry. However, conventional refrigerator appliances include doors that pivot around a single pivoting axis or hinge, which may cause the door or the panel mounted thereon to rub or conflict with adjacent cabinetry. In addition, refrigerator doors may frequently experience gasket rub or wear as the door is opened and closed repeatedly.

Accordingly, a refrigerator appliance with an improved hinge assembly would be useful. More particularly, a hinge assembly that reduces the likelihood of contact between the refrigerator door and adjacent cabinetry would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, an appliance is provided including a cabinet, a door, and a linear hinge assembly coupling the door to the cabinet. The linear hinge assembly includes a bearing assembly mounted to the cabinet and an elongated shaft received within the bearing assembly such that the elongated shaft is slidable along a translation axis. A cam is mounted to the door and is rotatably coupled to a distal end portion of the elongated shaft such that such that the door is rotatable about a pivot axis that extends through the distal end portion of the elongated shaft. A timing cable extends from a fixed location on the cabinet to a fixed location on a cam profile such that the timing cable wraps around the cam when the door is moved toward a closed position and unwraps when the door is moved toward an open position.

In a second example embodiment, a linear hinge assembly for coupling a door to a cabinet of an appliance is provided.

The linear hinge assembly includes a bearing assembly mounted to the cabinet and an elongated shaft received within the bearing assembly such that the elongated shaft is slidable along a translation axis. A cam is mounted to the door and is rotatably coupled to a distal end portion of the elongated shaft such that such that the door is rotatable about a pivot axis that extends through the distal end portion of the elongated shaft. A timing cable extends from a fixed location on the cabinet to a fixed location on a cam profile such that the timing cable wraps around the cam when the door is moved toward a closed position and unwraps when the door is moved toward an open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
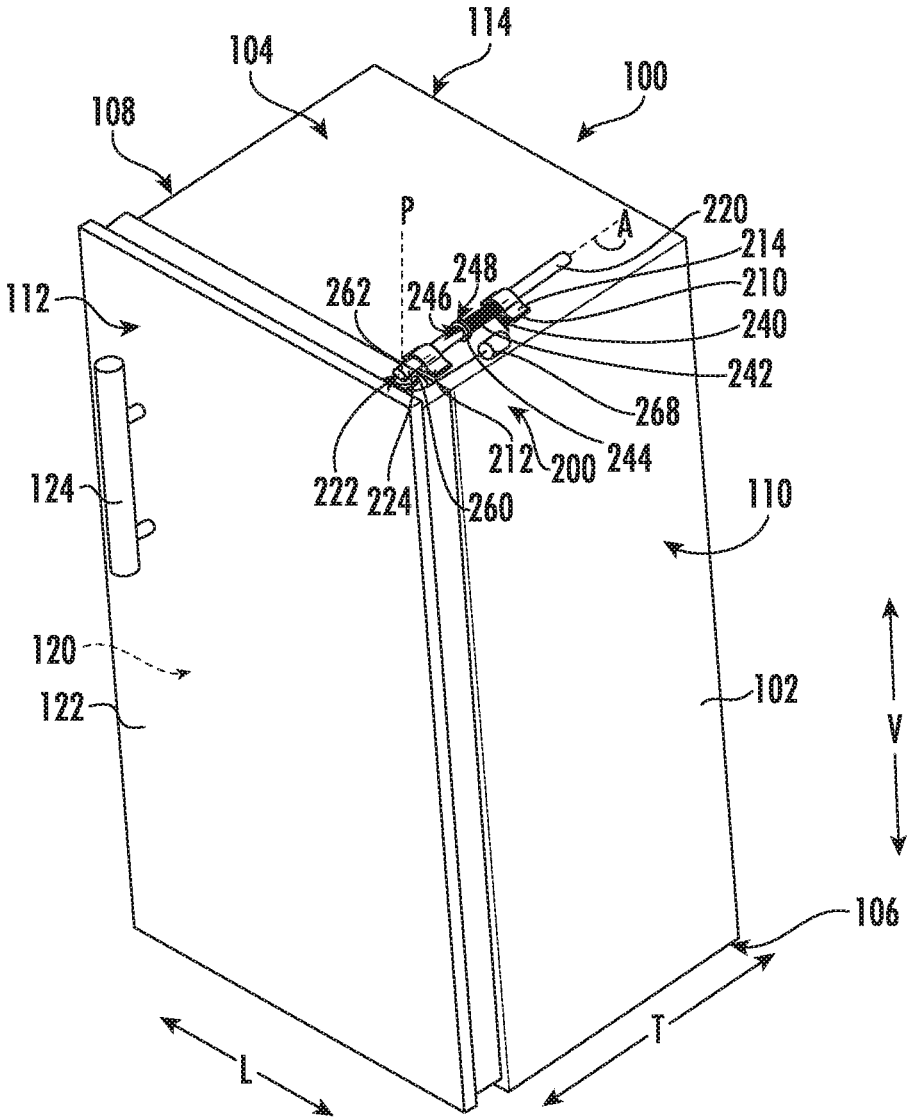
FIG. 1 is a perspective view of an appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an appliance 100, such as a refrigerator appliance, according to an example embodiment of the present subject matter. As may be seen in FIG. 1, appliance 100 includes a housing or cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Cabinet 102 generally defines one or more chilled chambers 120 for receipt of food items for storage. Cabinet 102 may be insulated and refrigerator appliance 100 may further include a sealed system (not shown) that is operable to cool chilled chamber 120 and food items stored therein. Although refrigerator appliance 100 is illustrated as a single compartment refrigerator, it should be appreciated that aspects of the present subject matter may be applied to other types of refrigerator appliances, such as bottom mount, top mount, and side-by-side refrigerator appliances. Moreover, aspects of the present subject matter may be used for any other suitable appliance that includes a rotating door. For example, aspects of the present subject matter may be used in or with french door oven appliances, dishwasher appliances, etc. to mount a door to a cabinet, such as a base, a tub, etc.

Referring still to FIG. 1, a door 122 is coupled to cabinet 102 with one or more linear hinge assemblies 200, e.g., located at a top and a bottom of door 122. A user may rotate door 122 open to access and interior of cabinet 102 (e.g., chilled chamber 120), and the user may rotate door 122 closed to seal the interior of cabinet 102. Door 122 may also include a handle 124 that a user may pull when opening and closing door 122. Linear hinge assemblies 200 will be described herein in more detail according to exemplary embodiments of the present subject matter. In general, linear hinges are used to allow doors to translate away from adjacent cabinetry or appliances in addition to rotating open and closed. By translating in addition to rotating, interference between the doors and the adjacent cabinetry or the appliance itself can be avoided.

Figure 2:
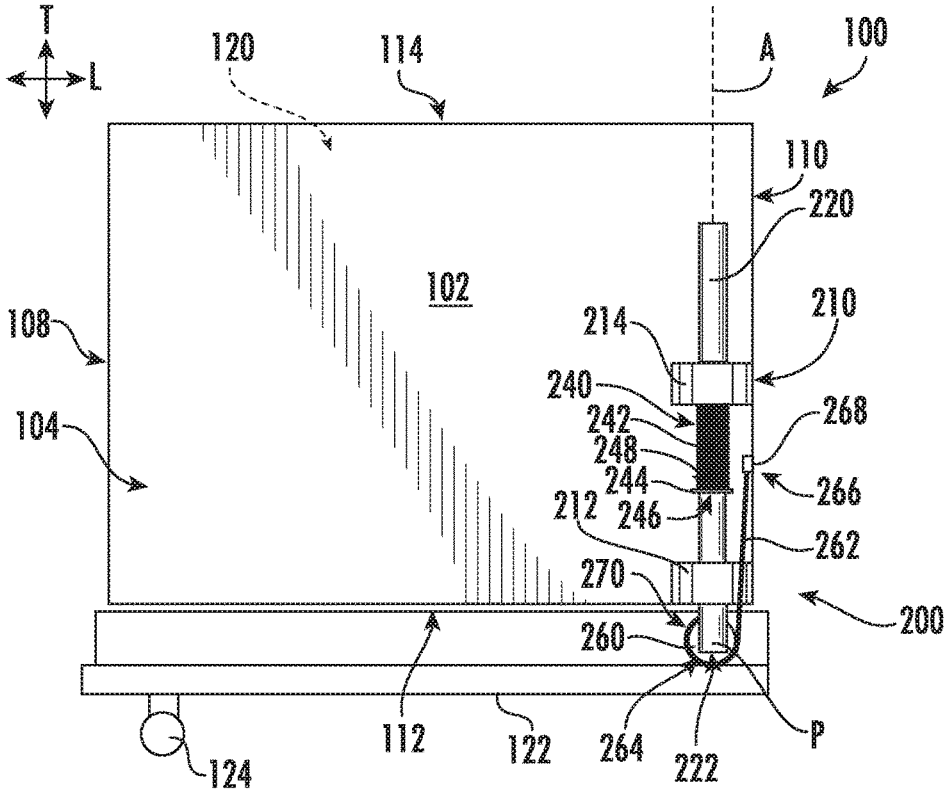
FIG. 2 is a top, plan view of a linear hinge assembly of the exemplary appliance of FIG. 1 in a closed position according to an exemplary embodiment of the present subject matter.
Figure 3:
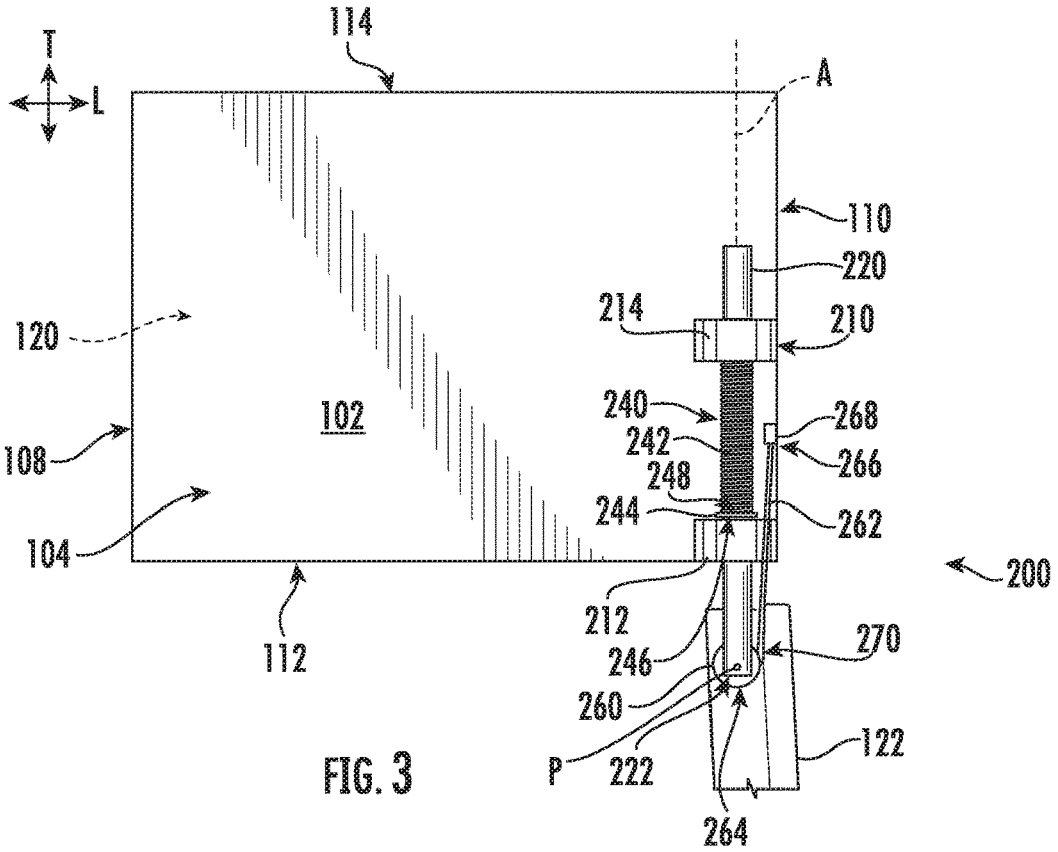
FIG. 3 is a top, plan view of the exemplary linear hinge assembly of FIG. 2 in an open position according to an exemplary embodiment of the present subject matter.
Figure 4:
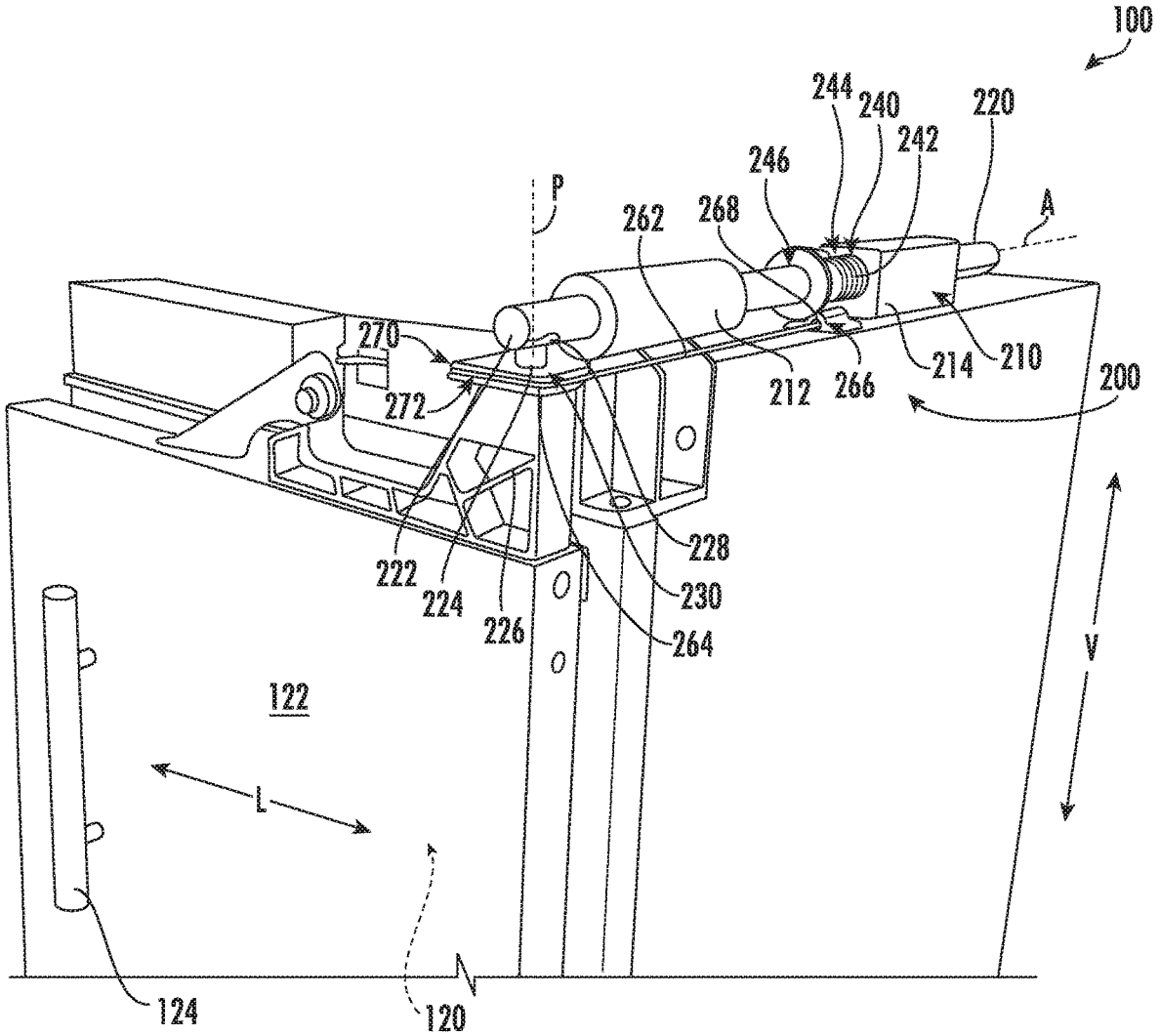
FIG. 4 is a perspective view of a linear hinge assembly of the exemplary appliance of FIG. 1 in the closed position according to an exemplary embodiment of the present subject matter.
Figure 5:
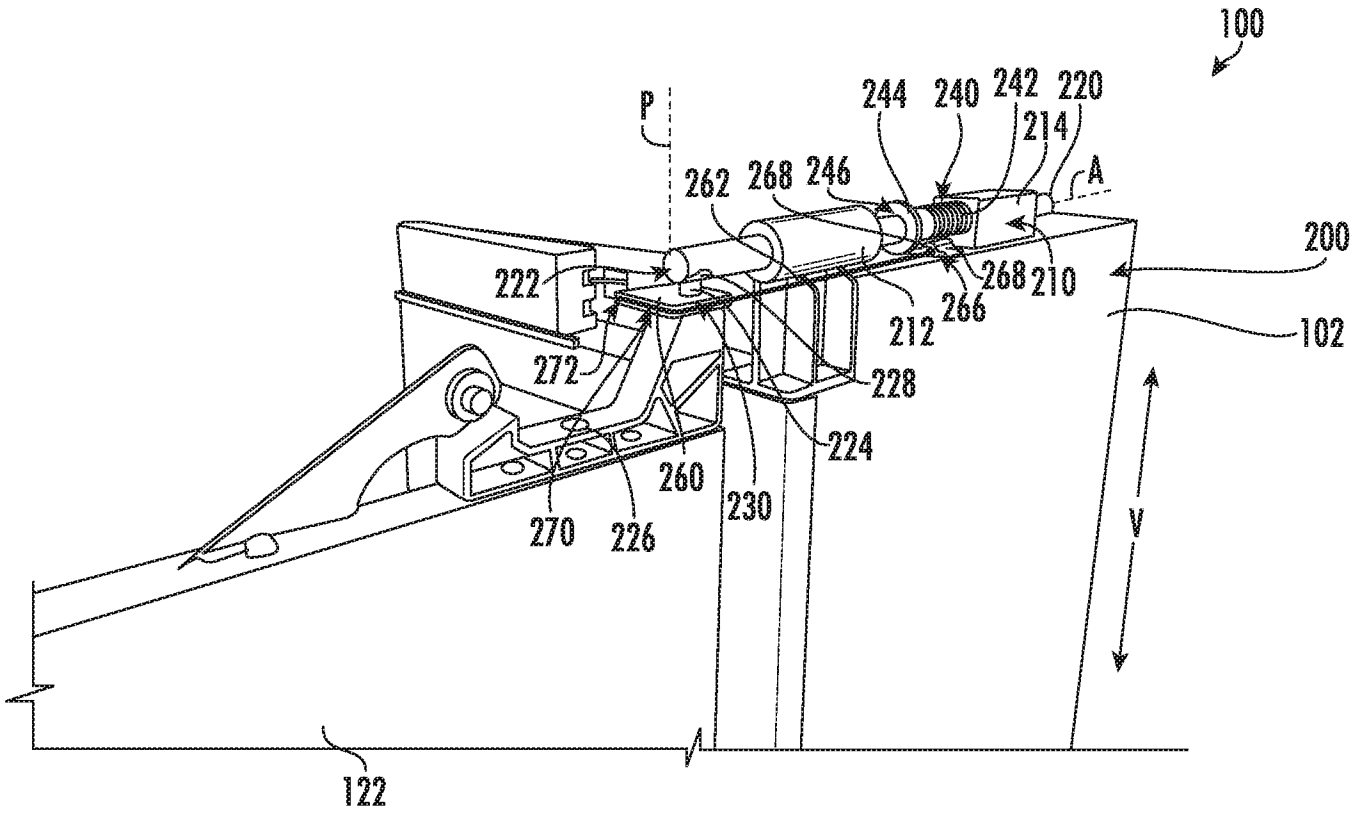
FIG. 5 is a perspective view of the exemplary linear hinge assembly of FIG. 4 in the open position according to an exemplary embodiment of the present subject matter.

Referring generally to FIGS. 1 through 5, linear hinge assemblies 200 will be described in more detail according to an exemplary embodiment. Specifically, FIGS. 2 and 3 include top views of a linear hinge assembly 200 in the closed and open positions, respectively. FIGS. 4 and 5 include perspective views of another linear hinge assembly 200 in the closed and open positions, respectively. Due to the similarity between the embodiments of linear hinge assemblies 200 described herein, like reference numerals will be used to refer to the same of substantially similar features between embodiments. Although only top linear hinge assemblies 200 are illustrated and described in detail, it should be appreciated that refrigerator appliance 100 may include bottom hinge assemblies that are substantially similar to the top linear hinge assemblies 200.

As illustrated, linear hinge assembly 200 includes at least one bearing assembly 210 mounted to cabinet 102. As an example, bearing assembly 210 may be fastened or otherwise suitably fixed to cabinet 102. More specifically, as illustrated, bearing assembly 210 includes a front bearing 212 and a rear bearing 214 spaced apart along a translation axis A, which may correspond to the transverse axis T of appliance 100. Although bearing assembly 210 is illustrated as including two linear slide bearings, it should be appreciated that bearing assembly 210 may include any suitable number and type of bearing configuration, such as ball bearings, low friction sleeves, or any other suitable slide or linear shaft bearings.

An elongated shaft 220 is received within bearing assembly 210. In particular, elongated shaft 220 may slide along translation axis A on or within bearing assembly 210. Thus, for example, elongated shaft 220 may extend and retract along the translation axis A on bearing assembly 210 as door 122 opens and closes. Notably, as described below, this translation provides clearance or minimizes interference between door 122 and adjacent cabinetry or other structures. Elongated shaft 220 may be formed from any suitably rigid material or materials. For example, according to an exemplary embodiment, elongated shaft 220 may be a steel rod. In addition, elongated shaft 220 may be coated in any suitable coating, such as anodized aluminum or another suitable corrosion resistant coating.

A distal end portion 222 of elongated shaft 220 may be cantilevered from bearing assembly 210, and distal end portion 222 of elongated shaft 220 is rotatably connected to door 122. In particular, door 122 is rotatable about a pivot axis P that extends through distal end portion 222 of elongated shaft 220. The pivot axis P may be perpendicular to the translation axis A. For example, the pivot axis P may be vertically oriented, and the translation axis A may be horizontally oriented.

As shown, door 122 is connected to cabinet 102 with linear hinge assembly 200 such that door 122 is translatable along the translation axis A relative to cabinet 102 and is also rotatable about the pivot axis P relative to cabinet 102. Thus, e.g., when door 122 includes an outer panel that is flush mounted with adjacent cabinetry, linear hinge assembly 200 may translate door 122 along the translation axis A away from cabinet 102 as door 122 is rotated open about the pivot axis P. Translating door 122 away from cabinet 102 as door 122 rotates open assists with reducing interference between door 122 and adjacent cabinetry. In addition, translating door 122 away from cabinet 102 as door 122 rotates open may also assist with limiting scraping of door 122 on a gasket (not shown) that extends between cabinet 102 and door 122 to seal the interior of cabinet 102.

In certain example embodiments, linear hinge assembly 200 includes a vertical hinge pin 224 that is mounted to door 122 to facilitate rotation relative to cabinet 102. Specifically, according to the illustrated embodiment, a hinge bracket 226 may be mounted at a top and bottom of door 122. Vertical hinge pins 224 may be mounted within hinge brackets 226 such that they do not rotate relative to the door 122. However, vertical hinge pin 224 is rotatably coupled to the distal end portion 222 of elongated shaft 220.

More specifically, as illustrated, vertical hinge pin 224 may be elongated and extend between a top end 228 and a bottom end 230 along the pivot axis P, e.g., substantially parallel to the vertical direction V. It should be appreciated that as used herein, terms of approximation, such as "approximately," "substantially," or "about," refer to being within a ten percent margin of error. Door 122 is attached to vertical hinge pin 224 at the bottom end 230. Elongated shaft 220 is rotatably coupled to vertical hinge pin 224 at top end 228. For example, bottom end 230 of vertical hinge pin 224 may be received within a hole defined by hinge bracket 226 of door 122 (e.g., on a top edge of door 122), and the opposite top end 228 may be received within a hole defined by elongated shaft 220.

As illustrated in the figures, linear hinge assembly 200 may further include a biasing member 240 which is operably coupled to elongated shaft 220 and is configured for urging elongated shaft 220 to an extended position. Specifically, biasing member 240 may generally be configured for urging elongated shaft 220 toward front side 112 of cabinet 102 along the translation axis A. In this manner, biasing member 240 may generally be configured for creating a gap between door 122 and cabinet 102 as door 122 moves toward the open position.

Biasing member 240 may generally be any resilient member suitable for urging elongated shaft 220 along the translational axis A. For example, according to the illustrated embodiment, biasing member 240 is a mechanical spring 242 wrapped around or positioned coaxially with elongated shaft 220. According to alternative embodiments, biasing member 240 may include a plurality of mechanical springs, hydraulic pistons, or other mechanical devices that are aligned or oriented for urging elongated shaft 220 toward the extended position (e.g., as shown in FIGS. 3 and 5). By contrast, when door 122 is closed by a user, biasing member 240 is compressed and elongated shaft 220 moves toward the retracted position (e.g., as shown in FIGS. 2 and 4).

Linear hinge assembly 200 may further include additional features for limiting or restricting the translation of elongated shaft 220 within bearing assembly 210. For example, linear hinge assembly 200 may include one or more positive stops to prevent elongated shaft 220 from sliding all the way out of bearing assembly 210, or for otherwise defining a fully open position of door 122. Specifically, according to the illustrated embodiment, linear hinge assembly 200 includes a stop collar 244 that is mounted to or defined by elongated shaft 220. As shown, stop collar 244 extends outward along a radial direction R (e.g., defined perpendicular to translation axis A). In this manner, stop collar 244 is configured for engaging bearing assembly to limit the motion of elongated shaft 220 along the translation axis A at a desired stopping point. More specifically, according to the illustrated embodiment, a front face 246 of stop collar 244 engages the rear face of front bearing 212 when door 122 is in the fully open position.

It should be appreciated that the size, position, and configuration of stop collar 244 may vary while remaining within the scope of the present subject matter. For example, stop collar 244 is illustrated as a ring that is fixed to elongated shaft 220, e.g., by a set screw. However, stop collar 244 could alternatively be pin or protrusion defined on elongated shaft 220. In addition, stop collar 244 is illustrated as being positioned at a midpoint of elongated shaft 220 and being positioned between front bearing 212 and rear bearing 214. However, according to alternative embodiments, stop collar 244 could be defined at any other suitable location for achieving any other suitable motion of elongated shaft 220, and thus door 122.

In addition, according to exemplary embodiments, stop collar 244 may serve the additional purpose of compressing biasing member 240. Specifically, according to the illustrated embodiment, mechanical spring 242 is positioned on the elongated shaft 220 and extends from rear bearing 214 to a rear face 248 of stop collar 244. In this manner, for example, when door 122 is in the closed position, mechanical spring 242 is fully compressed between stop collar 244 and rear bearing 214. When a user begins to open door 122, mechanical spring 242 may extend elongated shaft 220 and facilitate the movement of door 122 away from cabinet 102.

Referring still to FIGS. 1 through 5, linear hinge assembly 200 may further include features to facilitate the easy closing of door 122. In this regard, it is desirable to have features which help close door 122 without requiring a user to push door 122 and elongated shaft 220 toward the retracted position and compress biasing member 240. Thus, according to the illustrated embodiment, linear hinge assembly 200 further includes a cam 260 which is mounted to door 122 such that it is not rotatable relative to door 122. However, cam 260 may be rotatably coupled to a distal end portion 222 of elongated shaft 220. More specifically, as illustrated, cam 260 is mounted directly to vertical hinge pin 224 such that cam 260 rotates (along with door 122) about pivot axis P which extends through distal end portion 222 of elongated shaft 220.

In addition, linear hinge assembly 200 includes a timing cable 262 that extends from a fixed location on cabinet 102 to a fixed location on a cam profile 264 defined by cam 260. In this manner, timing cable 262 wraps around cam profile 264 of cam 260 when door 122 is moved toward the closed position. By contrast, when door 122 is opened, timing cable 262 may unwind or unwrap from cam 260. It is preferable that timing cable 262 is a non-extendable wire or cable, e.g., such as a metal wire. A first end 266 of timing cable may be fixedly mounted to a cable bracket 268 on cabinet 102. A second end 270 of timing cable 262 may be fixed at a particular location on cam profile 264.

As illustrated, cam 260 generally extends within a horizontal plane (e.g., defined by the lateral direction L and transverse direction T). In addition, cam 260, or more specifically cam profile 264, may define a receiving groove 272 that extends within the horizontal plane for receiving timing cable 262 and preventing timing cable 262 from falling off of cam 260. In this manner, as cam 260 rotates along with door 122, the rotation of cam 260 causes timing cable 262 to wrap or unwrap to facilitate movement of door 122. Notably, the shape and pivot point of cam 260 may vary to adjust the translation of door 122. For example, according to the illustrated embodiment, cam profile 264 contacts timing cable 262 at a location offset from pivot axis P of door 122. In addition, according to the illustrated embodiment of FIGS. 1 through 3, cam profile 264 is substantially circular. However, according to an alternative embodiment illustrated in FIGS. 4 and 5, cam profile 264 is noncircular, e.g., such that the same rotational motion of door 122 may draw in or wrap more timing cable 262 to facilitate a further translation of door 122 relative to cabinet 102.

In operation, when appliance door 122 is in the closed position, elongated shaft 220 is biased toward rear side 114 of cabinet 102, biasing member 240 is compressed, and a door gasket (not shown) forms a seal between door 122 and cabinet 102. In addition, timing cable 262 is in a fully wrapped position around cam 260. In this position, biasing member 240 applies a forward force to elongated shaft 220 and door 122, but door 122 remains in the closed position because it is restrained by timing cable 262. As a user opens door 122 by rotating door 122 about pivot axis P, timing cable 262 begins to unwrap or unwind off of cam 260, thereby allowing biasing member 240 to move door 122 forward and away from cabinet 102 by sliding along translation axis A. As the angle of opening of door 122 is increased, more timing cable 262 pays out or unwinds and elongated shaft 220 may slide forward on bearing assembly 210. Notably, the diameter and shape of cam profile 264 dictates the relationship between the rotation of door 122 and the amount of timing cable 262 that pays out for a given angle of rotation. As door 122 is fully opened, forward travel of the elongated shaft 220 may be limited by stop collar 244 engaging against front bearing 212. Conversely, as door 122 is rotated toward the closed position, timing cable 262 wraps around cam 260, thereby compressing biasing member 240 and pulling door 122 toward cabinet 102.

In addition to providing clearance between door 122 and cabinet 102, aspects of the present subject matter result in no pinching or crush points, and is aesthetically pleasing due to its linear design and minimal use of exposed components. Linear rods such as elongated shaft 220 are inherently strong, facilitate smooth travel, and result in the ability to carry very heavy doors with ease. In addition, the linear motion of elongated shaft 220 and door 122 eliminates gasket scrubbing against the case, resulting in fewer replacement components and maintenance calls.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An appliance, comprising:

a cabinet;

a door;

a linear hinge assembly coupling the door to the cabinet, the linear hinge assembly comprising:

a bearing assembly mounted to the cabinet;

an elongated shaft received within the bearing assembly such that the elongated shaft is slidable along a translation axis;

a cam mounted to the door and being rotatably coupled to a distal end portion of the elongated shaft such that the door is rotatable about a pivot axis that extends through the distal end portion of the elongated shaft; and a timing cable extending from a fixed location on the cabinet to a fixed location on a cam profile such that the timing cable wraps around the cam when the door is moved toward a closed position and unwraps when the door is moved toward an open position.

2. The appliance of claim 1, wherein the linear hinge assembly further comprises:

a biasing member operably coupled to the elongated shaft and being configured for urging the elongated shaft to an extended position and the door toward the open position.

3. The appliance of claim 2, wherein the biasing member is a mechanical spring positioned coaxially around the elongated shaft.

4. The appliance of claim 2, wherein the linear hinge assembly further comprises:

a stop collar that extends from the elongated shaft substantially along a radial direction, the stop collar being configured for engaging the bearing assembly to limit the motion of the elongated shaft along the translation axis.

5. The appliance of claim 4, wherein the bearing assembly comprises:

a front bearing; and a rear bearing spaced apart from the front bearing along the translation axis, wherein the stop collar is mounted to the elongated shaft between the front bearing and the rear bearing.

6. The appliance of claim 5, wherein the stop collar is positioned approximately at a midpoint of the elongated shaft.

7. The appliance of claim 4, wherein the biasing member is positioned between the rear bearing and the stop collar such that the stop collar engages the biasing member to maintain the biasing member in compression.

8. The appliance of claim 1, wherein the linear hinge assembly further comprises:

a vertical hinge pin that has a top end rotatably coupled to the distal end of the elongated shaft and a bottom end fixedly mounted to the door, wherein the cam is mounted on the vertical hinge pin.

9. The appliance of claim 1, wherein the cam defines a receiving groove that extends within a horizontal plane for receiving the timing cable.

10. The appliance of claim 1, wherein the cam profile of the cam is noncircular.

11. The appliance of claim 1, wherein the cam contacts the timing cable at a location offset from a pivot axis of the door.

12. The appliance of claim 1, wherein the timing cable is non-extendible and has a first end fixed to the cabinet and a second end fixed to the cam.

13. The appliance of claim 1, wherein the linear hinge assembly comprises a top linear hinge assembly positioned at a top of the door and the appliance further comprises a bottom linear hinge assembly positioned at the bottom of the door.

14. A linear hinge assembly for coupling a door to a cabinet of an appliance, the linear hinge assembly comprising:

a bearing assembly mounted to the cabinet;

an elongated shaft received within the bearing assembly such that the elongated shaft is slidable along a translation axis;

a cam mounted to the door and being rotatably coupled to a distal end portion of the elongated shaft such that such that the door is rotatable about a pivot axis that extends through the distal end portion of the elongated shaft; and a timing cable extending from a fixed location on the cabinet to a fixed location on a cam profile such that the timing cable wraps around the cam when the door is moved toward a closed position and unwraps when the door is moved toward an open position.

15. The linear hinge assembly of claim 14, further comprising:

a biasing member operably coupled to the elongated shaft and being configured for urging the elongated shaft to an extended position and the door toward the open position.

16. The linear hinge assembly of claim 15, further comprising:

a stop collar that extends from the elongated shaft substantially along a radial direction, the stop collar being configured for engaging the bearing assembly to limit the motion of the elongated shaft along the translation axis.

17. The linear hinge assembly of claim 16, wherein the bearing assembly comprises:

a front bearing; and a rear bearing spaced apart from the front bearing along the translation axis, wherein the stop collar is mounted to the elongated shaft between the front bearing and the rear bearing.

18. The linear hinge assembly of claim 16, wherein the stop collar is positioned approximately at a midpoint of the elongated shaft.

19. The linear hinge assembly of claim 14, further comprising:

a vertical hinge pin that has a top end rotatably coupled to the distal end of the elongated shaft and a bottom end fixedly mounted to the door, wherein the cam is mounted on the vertical hinge pin.

20. The linear hinge assembly of claim 14, wherein the cam defines a receiving groove that extends within a horizontal plane for receiving the timing cable.

* * * * *